US005450923A

United States Patent [19]

Ker

[11] Patent Number: 5,450,923

[45] Date of Patent: Sep. 19, 1995

[54] FIRE ESCAPE DEVICE

[76] Inventor: Dern-Yen Ker, P.O. Box 1750, Taichung,

[21] Appl. No.: 57,865

[22] Filed: May 7, 1993

[51] Int. Cl.[6] ..... A62B 35/00

[52] U.S. Cl. ..... 182/239; 182/234

[58] Field of Search ..... 182/234, 239, 231, 232, 182/235, 236, 237, 238, 240, 73, 71, 70, 42–44

[56] References Cited

U.S. PATENT DOCUMENTS 1,233,540 7/1917 Astarita ..... 182/71
4,287,963 9/1981 Coxsey ..... 182/236 X
4,671,384 6/1987 Sing ..... 182/239 X
4,997,064 3/1991 Motte et al. ..... 182/236 X

*Primary Examiner*—Alvin C. Chin-Shue

[57] ABSTRACT

A fire escape device includes a frame, two supports disposed on the frame, a rod having two ends extended through the supports a pulley fixed on the rod, a cable engaged over the pulley, a supporting member coupled to the cable for supporting persons, and a brake mechanism disposed in one of the supports for braking the rod. The brake mechanism includes a brake shoe pivotally supported in a housing, and one or more pushers disposed in the end portion of the rod for pushing the brake shoe to engage with the housing such that the rod is braked intermittently when the rod rotates.

7 Claims, 7 Drawing Sheets

FIRE ESCAPE DEVICE

BACKGROUND OF THE INVENTION

1. Field of the Invention

The present invention relates to a device, and more particularly to a fire escape device.

2. Description of the Prior Art

Various kinds of fire escapes have been developed and widely used in high buildings, one type of which includes a supporting means for supporting persons and a cable or the like coupled to the supporting means and wound and stored in a spool, the supporting means may be lowered to the ground when the cable is unwound from the spool. Most of the fire escapes are electrically operated, however, the electricity may be disconnected due to the fire such that the fire escapes may be become failure.

The present invention has arisen to mitigate and/or obviate the afore-described disadvantages of the conventional fire escapes.

SUMMARY OF THE INVENTION

The primary objective of the present invention is to provide a fire escape device which can be operated without electricity.

In accordance with one aspect of the present invention, there is provided a fire escape device comprising a frame including an extension extended therefrom, a pair of supports provided on the extension of the frame, a rod including two ends extended through the supports respectively and rotatably supported in place by the supports, a pulley fixed on the rod, a cable engaged over the pulley and including an end portion, a supporting means coupled to the end portion of the cable for supporting persons, and at least one brake mechanism provided to a first of the supports for braking a first of the ends of the rod, the brake mechanism including a housing fixed to the first support and having an inner peripheral surface, at least one brake shoe including a first end pivotally supported in the housing at a pivot axle and an engaging surface movable toward the inner peripheral surface when the brake shoe moves about the pivot axle for engaging with the inner peripheral surface, means for biasing the brake shoe so as to disengage the engaging surface of the brake shoe from the inner peripheral surface of the housing, and at least one pusher provided in the first end of the rod and extended radially outward of the first end of the rod for pushing the brake shoe toward the inner peripheral surface of the housing when the rod rotates, whereby, the rod is braked intermittently when the brake shoe is pushed toward the inner peripheral surface of the housing and when the rod rotates.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
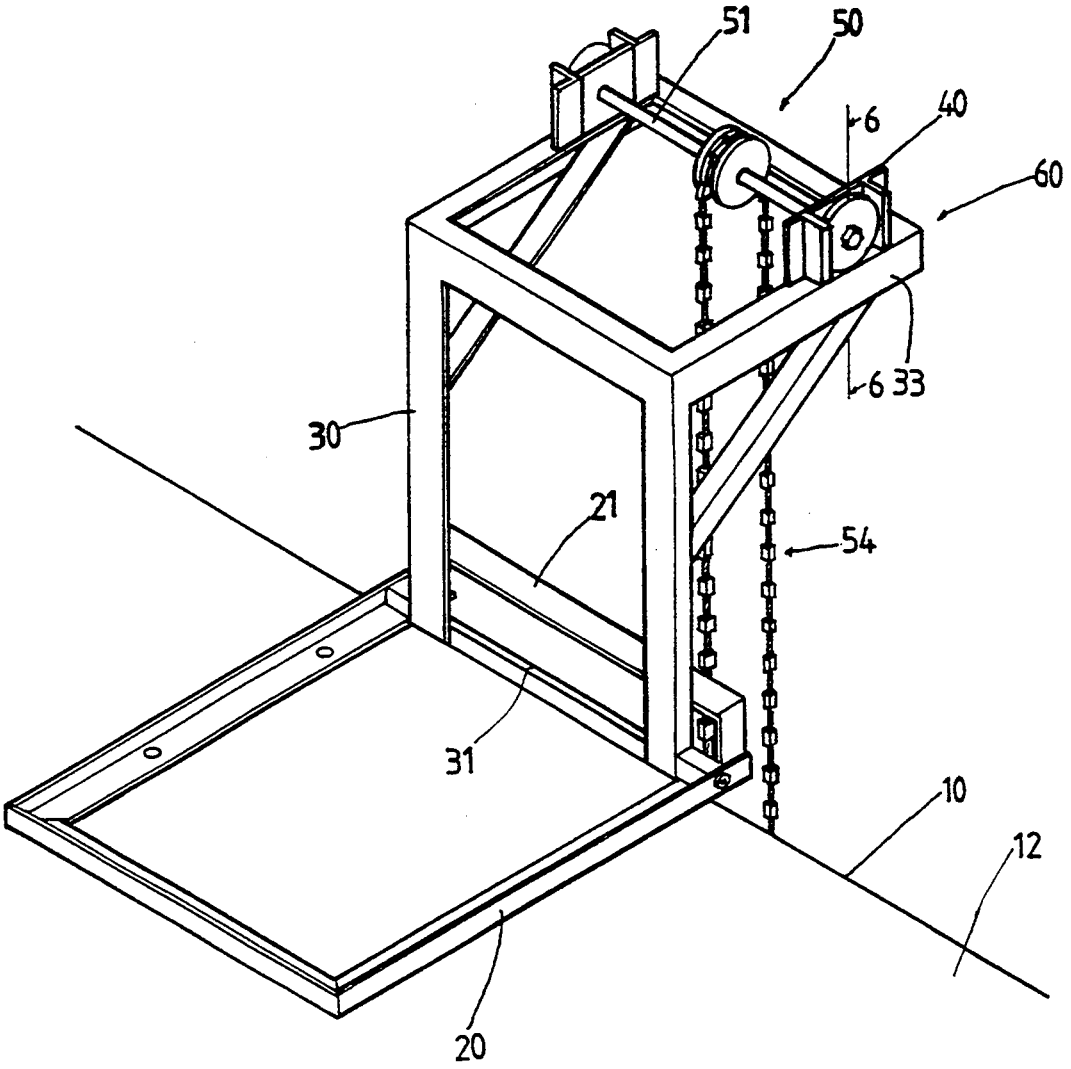
FIG. 1 is a perspective view of a fire escape device in accordance with the present invention.
Figure 2:
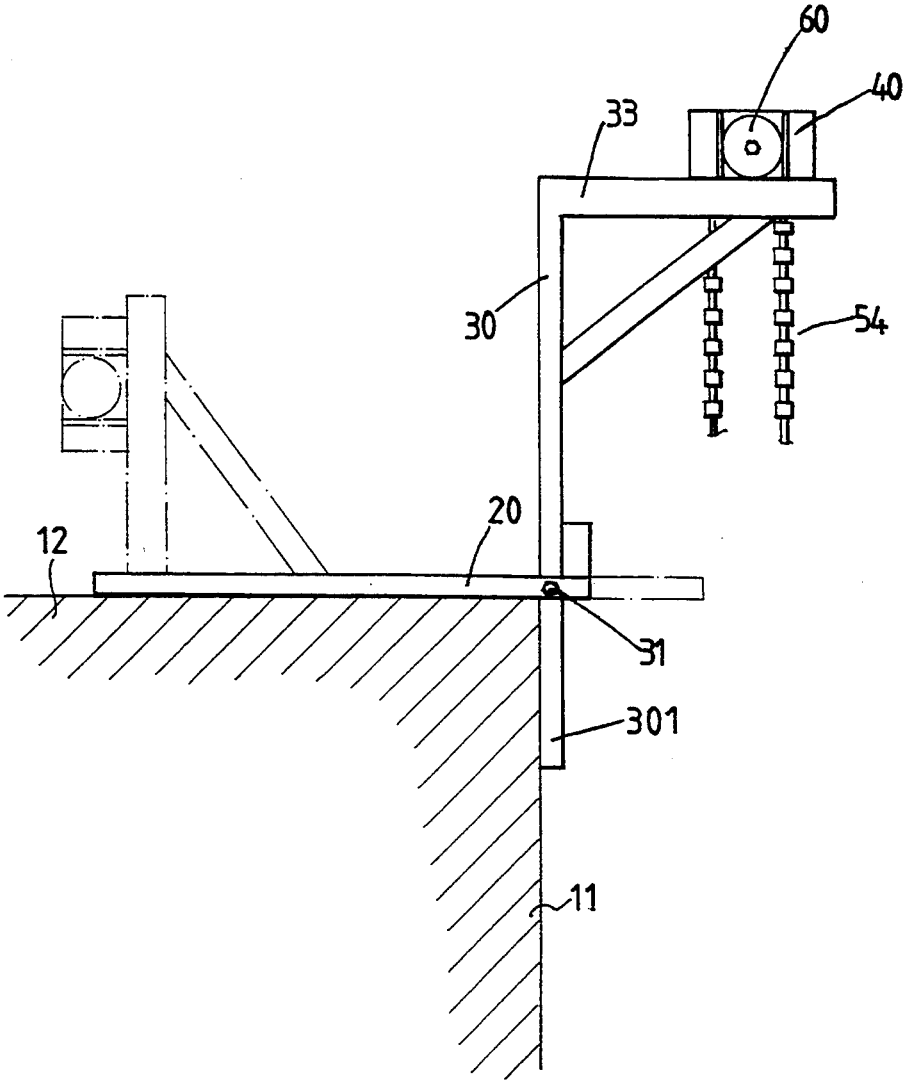
FIG. 2 is a side plane view of the fire escape device.

Referring to the drawings and initially to FIGS. 1 and 2, a fire escape device in accordance with the present invention is generally disposed on top of a building 10 including a corner having a vertical surface 11 and a horizontal surface 12, the fire escape device comprises a base 20 fixed on the horizontal surface 12 and having a stop 21 fixed on one end thereof and extended outward beyond the horizontal surface 12, a frame 30 including a middle portion pivotally coupled to the base 20 at a pivot axle 31 such that the frame 30 can be rotated relative to the base 20 from a working and vertical position as shown in solid lines in FIG. 2 to a rest and horizontal position as shown in dotted lines in FIG. 2. The frame 30 includes an extension 33 extended therefrom and extended in a horizontal position when said frame 30 is in the working position.

A pair of supports 40 are provided on the extension 33 of the frame 30 and each includes a brake mechanism 60 provided therein, a rod 51 includes two ends extended through the supports 40 respectively and fixed to the brake mechanisms 60 respectively, a pulley assembly 50 disposed on the rod 51, and a cable 54 engaged over the pulley assembly 50. A supporting means 80 (FIG. 4) is engaged to one end of the cable 54 for supporting persons.

Figure 3:
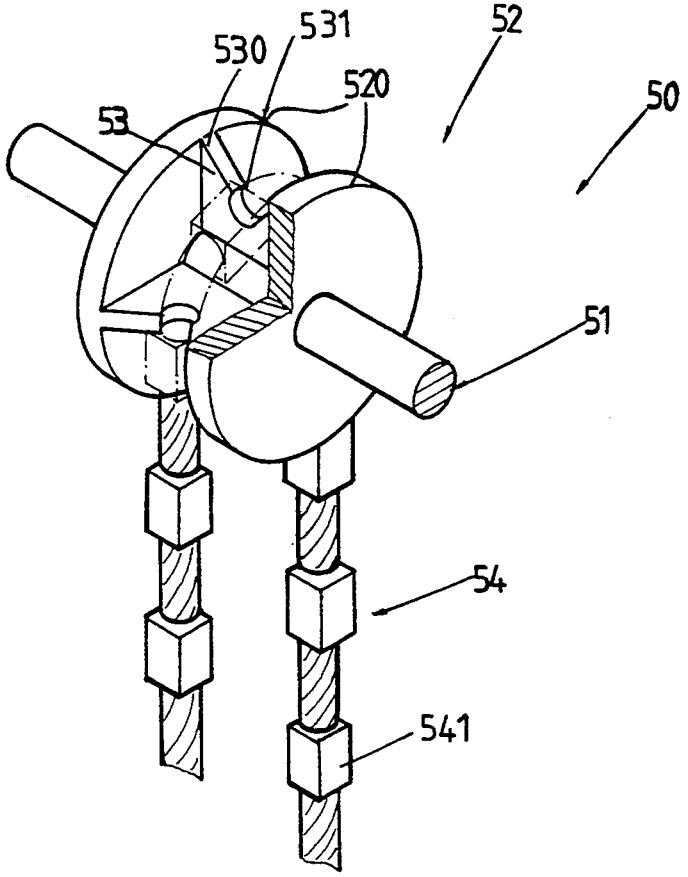
FIG. 3 is a partial perspective view illustrating the pulley of the fire escape device.

As shown in FIG. 3, the pulley assembly 50 includes a pulley 52 fixed on the rod 51 and having two plates 520 perpendicular to the rod 51 and a plurality of walls 53 secured between the plates 520, the walls 53 are extended radially outward from the rod and each includes a pair of tapered surfaces 530 formed in the radially outward portion thereof and a recess 531 formed between the tapered surfaces 530 for engaging with the cable 54, the cable 54 includes a plurality of blocks 541 fixed thereon and equally spaced with each other, the blocks 541 can be engaged with the walls 53 (FIG. 3) such that the cable 54 will not slip relative to the walls 53.

Figure 4:
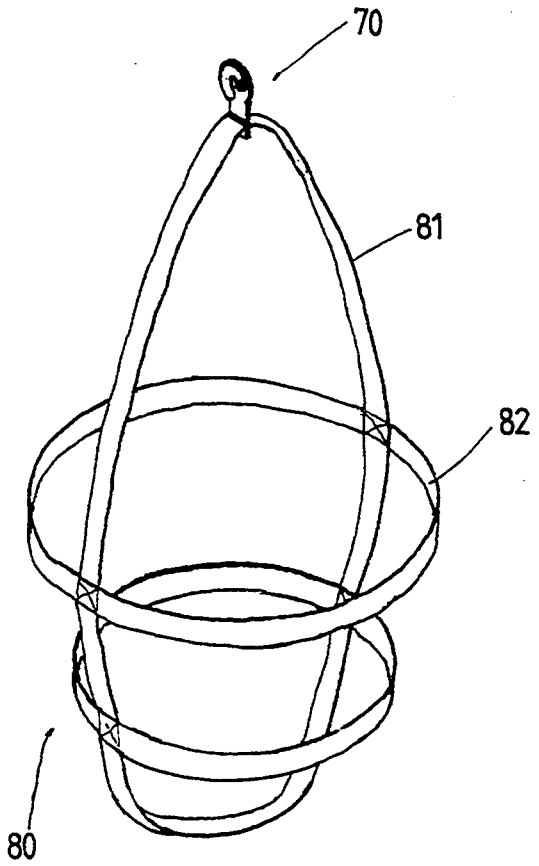
FIG. 4 is a perspective view of a supporting means.
Figure 5:
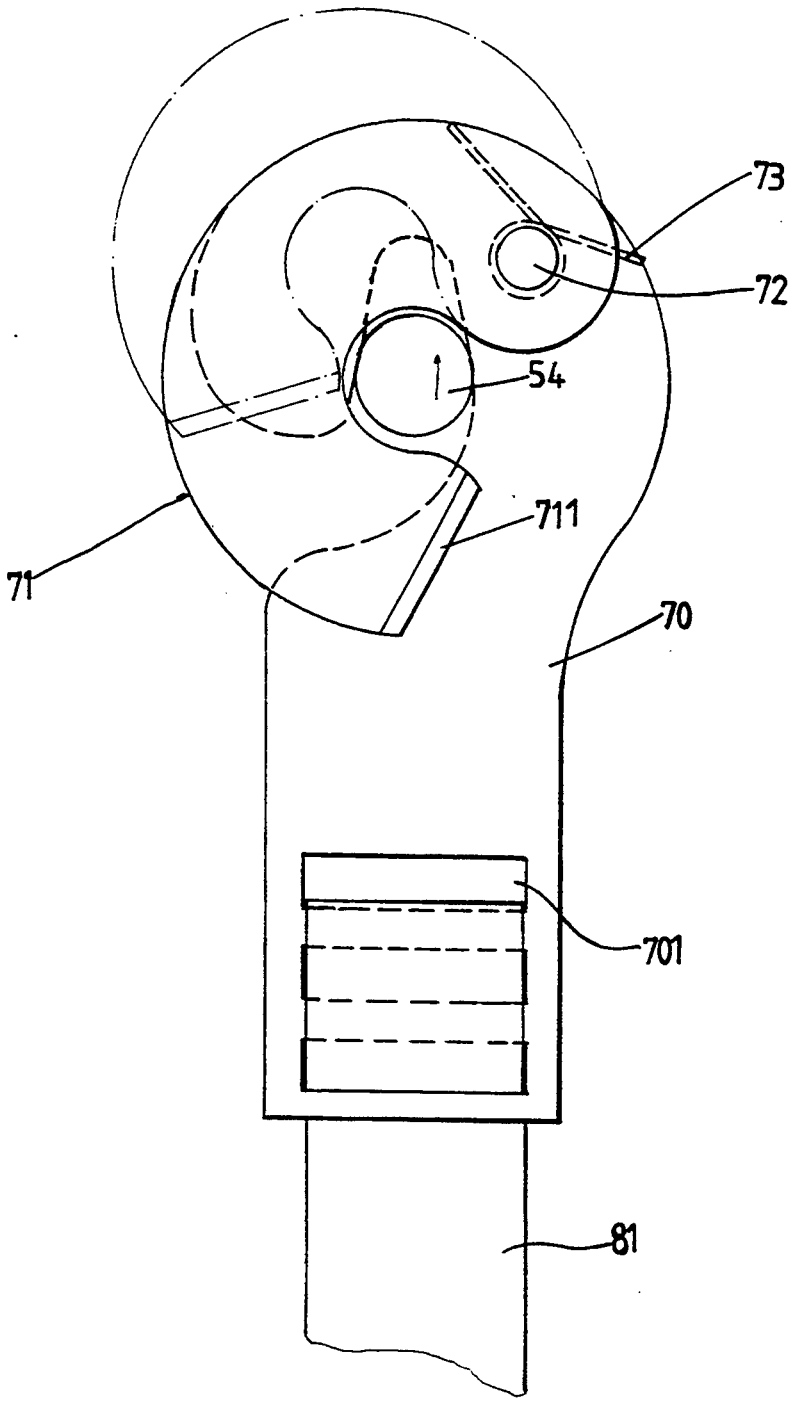
FIG. 5 is a schematic view illustrating the hook of the supporting means.

As shown in FIGS. 4 and 5, the supporting means 80 includes an endless 0-shaped belt 81 having a hook 70 disposed on the upper portion for engaging with the cable 54 and two endless belts 82 coupled to the belt 81 such that the persons can be supported within the supporting means 80. The hook 70 includes an engaging means 701 fixed to the belt 81, a shaft 72 provided therein, a retaining means 71 having one end pivotally engaged on the shaft 72, a spring 73 engaged on the shaft 72 for biasing the retaining means 71 to hold the cable 54 in place so as to prevent the cable 54 from disengaging from the cable 54. The retaining means 71 includes a handle 711 formed in the free end portion such that the retaining means 71 can be easily rotated relative to the hook 70 against the spring 73 so as to release the cable 54.

Figure 6:
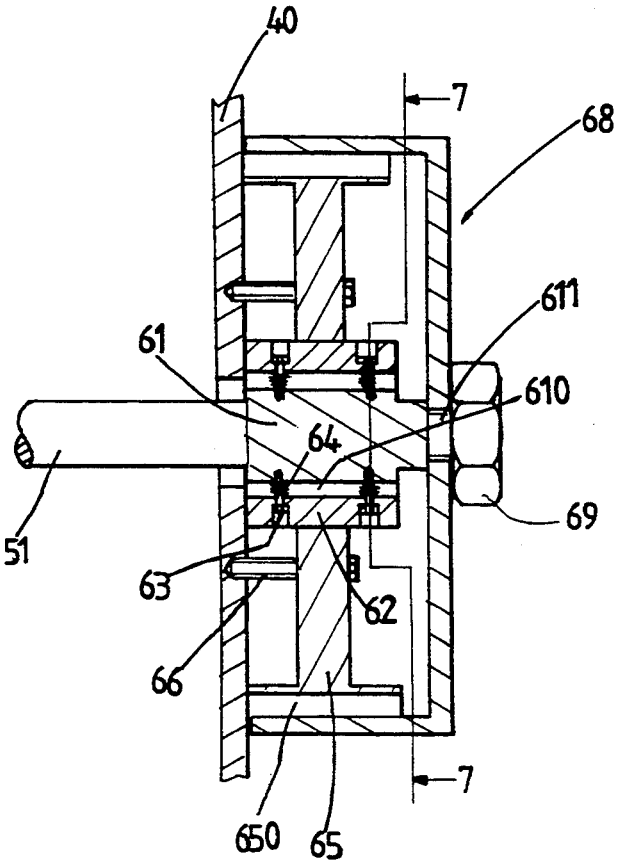
FIG. 6 is a cross sectional view taken along lines 6—6 of FIG. 1.
Figure 8:
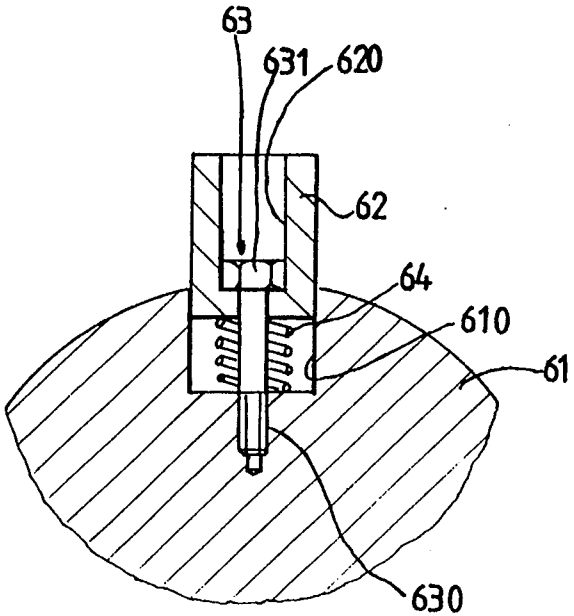
FIG. 8 is an enlarged partial cross sectional view of the elements as shown in FIG. 7.
Figure 7:
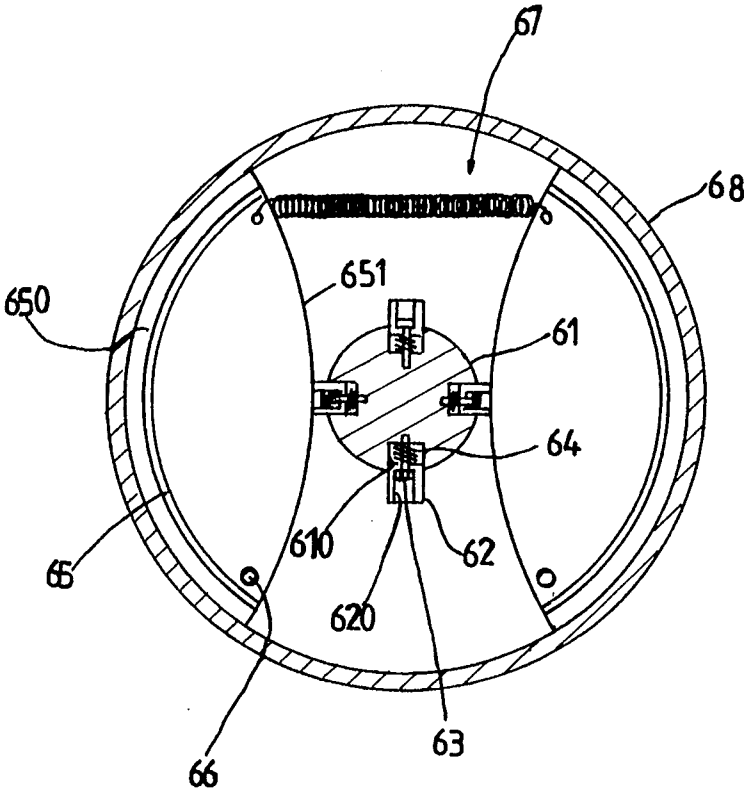
FIG. 7 is a cross sectional view taken along lines 7—7 of FIG. 6.

Referring next to FIGS. 6 to 8, each of the brake mechanisms 60 includes a housing 68 fixed to the respective supports 40, each of the ends of the rod 51 includes a stub 61 rotatably engaged in the housing 68 and extended outward of the housing 68 and fixed by a bolt 69, four depressions 610 are formed in the outer peripheral portion of the stub 61, a pusher 62 slidably received in each of the depressions 610 and including a bore 620 formed therein and opened away from the stub 61, a spring 64 engaged between the stub 61 and the pusher 62 for biasing the pusher 62 outward of the respective depressions 610, and a bolt 63 having one end 630 threaded to the stub 61 and having a head 631 slidably engaged in the bore of the pusher 62 and engaged with the pusher 62 so as to limit the outward movement of the pusher 62. A pair of brake shoes 65 are oppositely provided in the housing 68 and each has one end pivotally supported at a pivot axle 66 and has a spring 67 coupled between the other ends of the brake shoes 65 for pulling the brake shoes 65 toward each other, the brake shoes 65 each includes an engaging surface 650 for engaging with the inner surface of the housing 68 and a convex surface 651 engageable with the pushers 62 such that the surfaces 650 can be forced outward to engage with the housing 68 by the pushers 62 such that the rotation movement of the rod 51 can be braked.

It is to be noted that the brake shoes 65 are caused to engage with the housing 68 intermittently and are not continuously engaged with the housing 68 such that no high temperature will be generated between the brake shoes 65 and the housing 68.

Accordingly, the fire escape device in accordance with the present invention includes a brake mechanism which can be operated without electricity, in addition, the braking actions are operated intermittently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A fire escape device comprising a frame including an extension extended therefrom, a pair of supports provided on said extension of said frame, a rod including two ends extended through said supports respectively and rotatably supported in place by said supports, a pulley fixed on said rod, a cable engaged over said pulley and including an end portion, a supporting means coupled to said end portion of said cable for supporting persons, and at least one brake mechanism provided to a first of said supports for braking a first of said ends of said rod, said brake mechanism including a housing fixed to said first support and having an inner peripheral surface, at least one brake shoe including a first end pivotally supported in said housing at a pivot axle and an engaging surface movable toward said inner peripheral surface when said brake shoe moves about said pivot axle for engaging with said inner peripheral surface, means for biasing said brake shoe so as to disengage said engaging surface of said brake shoe from said inner peripheral surface of said housing, and at least one pusher provided in said first end of said rod and extended radially outward of said first end of said rod for pushing said brake shoe toward said inner peripheral surface of said housing when said rod rotates, whereby, said rod is braked intermittently when said brake shoe is pushed toward said inner peripheral surface of said housing and when said rod rotates.

2. A fire escape device according to claim 1, wherein said first end of said rod includes at least one depression formed therein for slidably receiving said pusher, a spring received in said depression for biasing said pusher outward of said rod to engage with said brake shoe, and a bolt extended through said pusher and threadedly engaged with said rod and having a head portion engaged with said pusher in order to limit the outward movement of said pusher relative to said depression.

3. A fire escape device according to claim 1, wherein said supporting means includes a hook provided therein for engaging with said cable, and a retaining means having a first end pivotally coupled to said hook and having a second end, and a spring for biasing said second end of said retaining means to enclose said cable so as to prevent said cable from disengaging from said hook.

4. A fire escape device according to claim 3, wherein said retaining means includes a handle provided therein for rotating said retaining means against said spring.

5. A fire escape device according to claim 1, wherein said pulley includes two plates fixed to said rod and perpendicular to said rod, and at least two walls coupled between said plates, each of said walls includes a recess formed in a radially outward portion thereof for engaging with said cable, and said cable includes a plurality of blocks fixed thereon and equally spaced with each other for engaging with said walls.

6. A fire escape device according to claim 5, wherein each of said walls includes a pair of tapered surface formed in said radially outward portion thereof, and said recess of each of said walls is formed between said tapered surfaces of the respective walls.

7. A fire escape device according to claim 1 further comprising a base disposed horizontally, said frame including a middle portion pivotally coupled to said base at a pivot axle, said frame being rotatable about said pivot axle from a horizontal position to a vertical position.

* * * * *